US007467736B2

(12) United States Patent
Delage

(10) Patent No.: US 7,467,736 B2
(45) Date of Patent: Dec. 23, 2008

(54) CLOSURE AND DISPENSING DEVICE

(75) Inventor: Jean-Francois Delage, Clamart (FR)

(73) Assignee: L'Oreal, Paris (FR)

( * ) Notice: Subject to any disclaimer, the term of this patent is extended or adjusted under 35 U.S.C. 154(b) by 497 days.

(21) Appl. No.: 10/946,066

(22) Filed: Sep. 22, 2004

(65) Prior Publication Data

US 2005/0092781 A1 May 5, 2005

Related U.S. Application Data

(60) Provisional application No. 60/506,728, filed on Sep. 30, 2003.

(30) Foreign Application Priority Data

Sep. 22, 2003 (FR) ..... 03 50581

(51) Int. Cl.
*B65D 5/72* (2006.01)

(52) U.S. Cl. ..... 222/498; 222/511; 220/823

(58) Field of Classification Search ..... 222/498, 222/499, 511–521, 550, 551–557, 533, 354, 222/534; 215/273, 295, 237; 220/254.5, 220/823, 836–839, 847, 833, 245.5
See application file for complete search history.

(56) References Cited

U.S. PATENT DOCUMENTS

| | | | | |
|---|---|---|---|---|
| 3,741,447 A | | 6/1973 | Miles et al. | |
| 4,124,151 A | | 11/1978 | Hazard | |
| 4,813,560 A | | 3/1989 | Begley | |
| 4,911,337 A | | 3/1990 | Rosenthal | |
| 5,038,957 A | * | 8/1991 | Gross | 220/840 |
| 5,392,938 A | * | 2/1995 | Dubach | 215/254 |
| 5,551,607 A | * | 9/1996 | DeJonge et al. | 222/505 |
| 5,868,265 A | | 2/1999 | Kobayashi | |
| 6,206,221 B1 | * | 3/2001 | Bando et al. | 220/254.5 |
| 7,004,349 B2 | * | 2/2006 | Heiberg et al. | 220/827 |

FOREIGN PATENT DOCUMENTS

| | | |
|---|---|---|
| FR | 1161611 | 9/1958 |
| WO | WO 00/35766 | 6/2000 |

* cited by examiner

*Primary Examiner*—Lien T Ngo
(74) *Attorney, Agent, or Firm*—Oblon, Spivak, McClelland, Maier & Neustadt, P.C.

(57) ABSTRACT

A closure and dispensing device intended to be fitted to a container. The device includes a body which can be mounted on the container, with the body including a dispensing aperture in communication with an opening by the container. A lid is stable in the open position, and capable of selectively closing off the dispensing aperture, with the lid being pivotable relative to the body about an axis of a hinge. At least one resiliently deformable strip connects the lid to the body, and the lid includes two ends on an axis perpendicular to the hinge axis. The hinge axis is preferably located relative to the ends so that opening of the lid can occur as a result of pressure exerted on a portion of the lid situated between the hinge axis and the opposite end of the lid. The opposite end of the lid preferably includes a portion which at least partially closes off the dispensing aperture.

95 Claims, 5 Drawing Sheets

CLOSURE AND DISPENSING DEVICE

CROSS REFERENCE TO RELATED APPLICATIONS

This document claims priority to French Application Number 03 50581, filed Sep. 22, 2003 and U.S. Provisional Application No. 60/506,728, filed Sep. 30, 2003, the entire contents of which are hereby incorporated by reference.

FIELD OF THE INVENTION

The invention relates to closure and/or dispensing devices. More particularly the invention relates to containers fitted with a dispensing cap. Preferably the dispensing cap includes a spring-effect hinge.

BACKGROUND OF THE INVENTION

Discussion of Background

Dispensing caps are extensively described in the prior art, and generally include a body capable of being mounted around a neck delineating an opening in the container. The cap further includes a lid connected to the body by means of a hinge. The body includes a dispensing aperture which is closed off by the lid when the cap is in the closed position. In the open position, the lid at least partially exposes the dispensing aperture to facilitate the withdrawal of product from the container.

Generally, in order to move from the closed position to the open position, it is necessary to hold the container in one hand while the other hand exerts pressure on a protuberant part of the lid. Preferably, this protuberant part is defined on a side diametrically opposite the hinge.

In the case where the hinge has a spring effect, the simple action of raising the lid relative to the body induces completion of the opening movement. The spring-effect hinge brings the lid to the open position provided that it is brought to an unstable balance position and a very slight movement away from this unstable position towards the open position is induced.

Dispensing caps of this kind are known, for example, from the teachings of U.S. Pat. No. 4,813,560 and U.S. Pat. No. 3,741,447.

Other dispensing caps are known, for example as in U.S. Pat. No. 4,124,151 and U.S. Pat. No. 4,911,337, in which the spring-effect hinge is obtained by engaging a ball joint on the lid into a boss on the body. The ball joint engaged in the boss forms the hinge axis about which the lid is able to pivot relative to the body. The spring effect is obtained from a resilient portion connecting an edge of the lid to an edge of the body. This resilient portion extends on a side of the hinge opposite that at which the lid is defined. In this case also, in order to induce the passage from the closed position to the open position of the lid, pressure must be exerted on a protuberant part of the lid, with the protuberant part being diametrically opposite the resilient portion.

Another type of dispensing cap is disclosed in FR 1,161,611. With this arrangement, the lid also includes a protuberant part and a hinge having a spring means. In this case, the protuberant part is defined on a side of the hinge opposite that on which the lid is defined. In order to expose the dispensing aperture, pressure is exerted on the outer surface of this protuberant part so as to create leverage.

In the embodiment taught by FR 1,161,611, the lid is capable of reverting resiliently to the closed position, but it presents a major drawback in that the open position is only obtained as long as pressure is being exerted on the protuberant part. The spring means exerts a permanent force tending to return the lid to the closed position. This spring means has no reversible unstable balance position enabling it to pass from a first stable position, for example closed, to a second stable position, for example open. In effect the spring is included within the thickness of the lid, and stiffens it. The partial opening provided by the lid is also dependent on the plastic properties of the lid inside which the spring means is disposed.

A container fitted with a cap according to FR 1,161,611 is not easy to manipulate. In effect, even though it allows the container to be held and opened with one hand. When the product is dispensed by orienting the dispensing aperture downward, with at least one finger of the hand having to hold the lid open, the hand is then forced to assume a twisted or awkward position. Moreover, with the hand grasping the container it is difficult or impossible to correctly adjust the inclination imparted to the container to a desired position given the complex position which it is compelled to assume.

Dispensing caps known in the prior art pose a number of problems. Those which can be held in the open position when the product is being dispensed can require the use of two hands in order to accomplish opening or closure of the dispensing caps. And those dispensing caps which can be opened and held with one hand pose problems in that opening can require pressure to be maintained on part of the lid.

SUMMARY OF THE INVENTION

There is a need for new and improved dispensing caps, preferably in which the lid has small or minimal dimensions whether in the open or closed position.

According to one aspect of the invention, a container having a dispensing cap is provided. In a closed position, this type of cap serves to close off an opening in the container on which it is mounted. In an open position the cap facilitates dispensing of the product held in the container via a dispensing aperture that is in fluid communication with the contents of the container. A spring-effect hinge serves to ease the passage from the closed position to the open position.

One object of the invention is to wholly or partially resolve the problems referred to above. To this end, the dispensing cap according to the invention, when mounted on a container, can be moved from the open position to the closed position and vice versa using the same hand that is holding the container. In addition, both the opening and closing actions can be obtained by exerting simple pressure on an upper bearing surface of the lid of the dispensing cap.

In accordance with one feature of the invention, the lid can be mounted rotatably relative to the body of the cap about an axis forming a hinge. In accordance with one example, the lid includes a bearing surface on each side of the axis forming the hinge. A first bearing surface serves to induce the opening action, and a second serves for the closing action. In addition, the hinge is preferably of the spring effect type so as to facilitate completion of the opening or closing movements.

According to an object of the invention, a closure and/or dispensing device is provided which can be fitted to a container. In accordance with one example, the device includes a body which is capable of being mounted on the container, and which presents a dispensing aperture in communication with an opening delineated by the container. A lid is capable of selectively closing off the dispensing aperture, with the lid being pivoted relative to the body about a hinge axis. In addition, the lid is capable, in the absence of any external force, of remaining in the open position. At least one resiliently deformable strip connects the lid to the body.

In accordance with a preferred example, the lid includes two ends on an axis perpendicular to the hinge axis. With this example, the hinge axis is located relative to the ends so that opening of the lid can occur as a result of pressure exerted on a portion of the lid situated between the hinge axis and a second end of the lid. The second end is opposite a first end which at least partially delineates a portion of the lid which closes off the dispensing aperture.

Another object of the invention is to provide a closure and/or dispensing device which can be mounted at the level of an opening in a container, with an example of the device including a body capable of being mounted around the opening, and with this body including a dispensing aperture in fluid communication with the container. A cover is pivotable relative to the body by a spring-effect hinge, with the lid incorporating two portions on each side of the hinge axis. A first portion of the lid is arranged to close off the dispensing aperture in the closed position. A second portion of the lid forms a bearing surface to enable the lid to be moved from the closed position to an open position. In addition, at least one resiliently deformable strip connects the lid to the body. Further, the second portion of the lid is at least partially accommodated in a cavity of the body when the lid is in the open position.

According to one example, a hinge is generally composed of two parts connected by a common axis about which at least one of the parts is able to turn. In a preferred embodiment, by way of example, the hinge is of the film-hinge type. When the hinge is defined by a thin film connecting the two parts, the axis about which the parts are able to turn corresponds to a thinner zone of the film extending linearly.

The term "spring effect pivot" refers to a pivot incorporating a resilient connecting strip configured so to provide an unstable position and/or to be subjected to maximum resilient strain (either in extension or in compression) in an intermediate position between the open position and the closed position. In accordance with an illustrated example, a resilient strip is attached to each of the parts so that the distance between the two points of attachment is variable when passing from the open position to the closed position. The strip has inherent resilience and can present an unstable balance position between the two open and closed positions.

By way of example, the resilient strip can have a length such that between the two open and closed positions there exists a position at which the extension or compression strain is at its maximum, which causes this intermediate position between the open position and the closed position to be unstable.

Advantageously, the lid can form a lever such that a force exerted on one of the two portions of the lid causes the two portions to pivot about the hinge axis. The term lever is understood to mean a unitary body formed in this instance by the lid, with the lever being mobile about an axis, in this instance about the hinge axis. The term leverage is understood to mean a distance between the point of application of a force and an axis forming a hinge of rotation.

Preferably, in the closed position, the spring-effect hinge is concealed by the lid, for example, between the lid and the body. The lid includes two portions defined on either side of this hinge. Each of the two portions can participate in concealing the hinge.

According to an example or particular embodiment, the spring-effect hinge can include a first part integral with the body, a second part integral with the lid, and the resilient strip connects these two parts.

In accordance with an example where the hinge is concealed under the lid in the closed position, the first part can then be attached to the rim of a cavity formed in the body, and the second part can be connected to the lower surface of the lid. In this case, the resilient strip can also be concealed by the lid in the closed position. Preferably, the second part is connected to the lower surface of the second portion of the lid, and the device is arranged to cause this second portion to at least partially enter the cavity.

The merit of having the hinge concealed under the lid, in the closed position, is to protect the hinge against soiling or any impact, for example, during storage of this type of device.

Advantageously, according to a preferred feature, this second part can be attached some distance from the ends of the upper surface of the lid, and the first part can be attached to an area of the rim of the cavity as close as possible to the dispensing aperture. In this case, the hinge can advantageously extend on a line separating the dispensing aperture on one hand and access to the cavity on the other.

Preferably, a hinge axis is capable of allowing elastic deformation as it passes from the closed position to the open position, notably under the effect of pressure exerted on the bearing surface. This elastic deformation causes the second part to move relative to the first part. By way of example, in the case where the hinge is of the film-hinge type, the zone forming the hinge axis can deform elastically so as be slightly lower than at rest.

As a variant, and/or in an additional manner, under the effect of the pressure exerted on the bearing surface, an upper surface of the lid can also be capable of compressing elastically towards the seating of the body.

In these two particular cases, and in accordance with an advantageous feature, the lower surface of the lid can incorporate a brace, and this brace then bears on the body and is capable of forming locally in proximity to the seating a new axis of rotation, or temporary hinge axis, during the movement from the closed position to the open position. This temporary hinge axis is preferably only formed during the period of time when pressure is exerted on the bearing surface, and when the hinge axis is capable of moving downward during the movement from the closed position to the open position. The brace is advantageous in that it makes it possible to momentarily modify the different leverages.

Preferably, the temporary hinge axis is formed between the dispensing aperture and the hinge axis. Thus, with a normal pressure force exerted on the bearing surface of the second portion, a greater force can initially be obtained at the first portion closing off the dispensing aperture. This arrangement can be advantageous when it is necessary to disengage a stud from the lower surface of the first portion of the lid of the dispensing aperture.

According to another or alternate advantageous aspect of the invention, the spring-effect hinge can be in a stable position in the open and closed positions, and pass through an unstable balance position between these two positions.

Again advantageously, in the open position, an angle defined between the body and the lid is preferably greater than 90°, and is also preferably not greater than 130°.

According to an advantageous aspect of the invention, passage from the closed position to the open position can be induced by a pressure exerted on the bearing surface. For example, the pressure can be exerted in at least one direction orthogonal to this bearing surface.

Further, by way of example, the second portion can have a length, along an axis orthogonal to the hinge axis, shorter than the length of the first portion relative to the same axis.

Advantageously, a lower face of the first portion can include a stud capable of engaging in a leaktight manner into the outlet aperture.

According to another advantageous feature, the device can include an arrangement to lock the lid in the closed position so as to prevent the lid from moving from the closed position to the open position, with this locking arrangement being capable of cooperating with a rim of the cavity so as to prevent rotation of the second portion relative to the hinge axis. The merit of such a locking arrangement is to avoid inadvertent and unwanted opening of the lid, for example, as a result of impact or dropping which might occur with a container fitted with such a device. This locking arrangement can increase the length of the lid on an axis orthogonal to the hinge axis, such that at rest, in the closed position, the locking arrangement is close to or bearing against the rim.

In accordance with an illustrated example, the position of the locking arrangement is maintained under the effect of a resilient tab which holds it in the at-rest position. To facilitate the passage from the closed position to the open position, it is first necessary to exert pressure on this locking arrangement, thereby placing the resilient tab under strain. When the tab is under strain, the locking arrangement is preferably displaced axially along an axis orthogonal to the hinge. At the same time as this pressure is exerted in a direction at least parallel to the bearing surface, the user preferably applies pressure in a direction at least orthogonal to the bearing surface of the lid, to induce the opening movement.

According to a first embodiment or example, the locking of the closed position can be provided by a locking arrangement fitted to the lid. In this case, alternatively, the resilient tab can also be placed under strain in its locking position, and the locking arrangement then bears against an inner surface of the rim of the cavity.

According to a second embodiment or example, the locking arrangement can be formed as a single piece with at least part of the lid.

Preferably, pressure exerted on an outer surface of the locking arrangement, in at least one direction parallel to the bearing surface, facilitates compression of the resilient tab, and thus enables the movement from the closed position to the open position.

Advantageously, the device is preferably made in one piece by molding of a thermoplastic material, preferably selected from the polyolefins group. For example, the device can be molded of polypropylene.

In accordance with another object of the invention, a container is provided which is fitted with a closure and/or dispensing device as described herein.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1A:
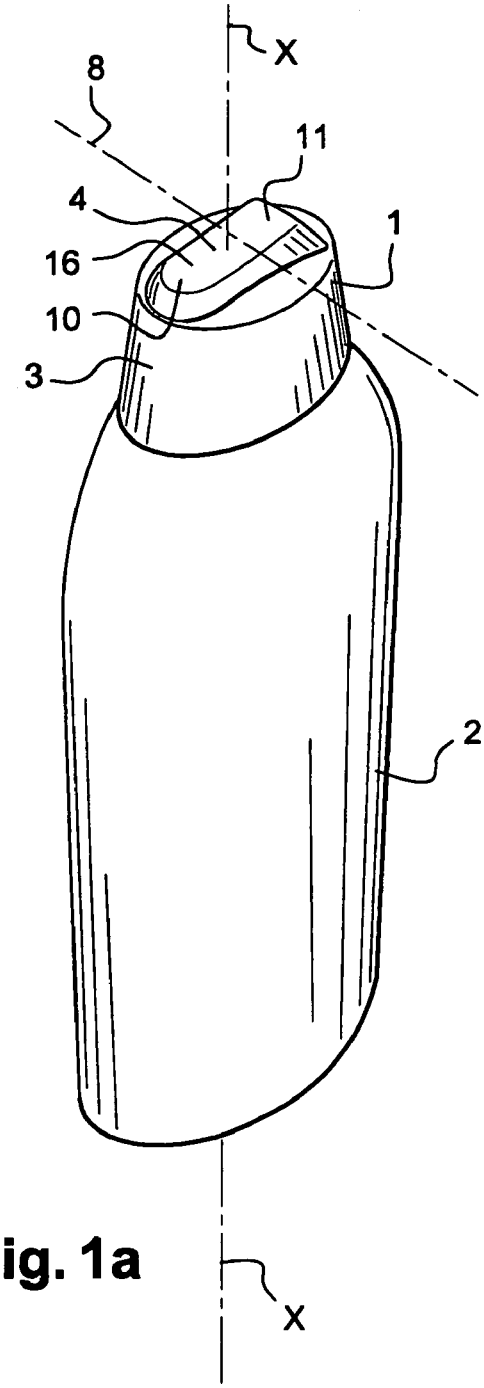
FIG. 1*a* is a profile or perspective view of a container fitted with a device according to the invention in the closed position.

FIG. 1*a* illustrates a closure device 1 mounted on a container 2. The container 2 has, for example, an elongated shape along an axis X. The device includes an opening, not visible in FIG. 1*a*, preferably defined orthogonally to this axis X. The device 1 principally includes a body 3 mounted on the container 2, and a lid 4. The body 3 is preferably mounted permanently on the container 2, for example by cooperation between a projection on a inner circumference of the body 3 and a counterpart projection on an outer circumference of the container 2.

Figure 1B:
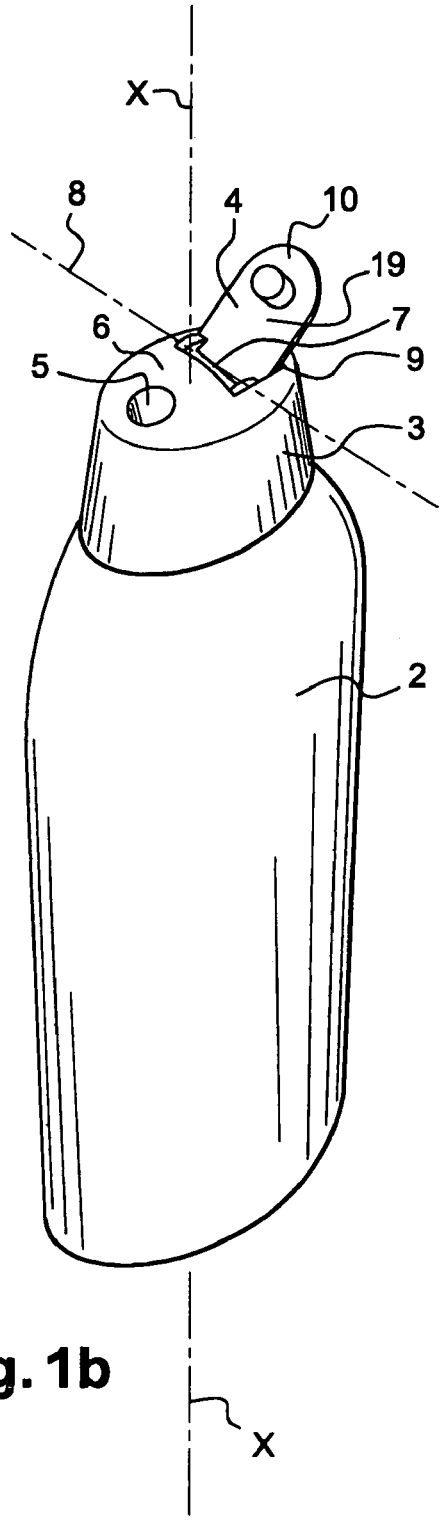
FIG. 1*b* is a perspective view of a container fitted with a device according to the invention in the open position.

The lid 4 is movable relative to the body 3, as can be seen in FIG. 1*b* where the lid 4 is in the open position, whereas in FIG. 1*a* the lid 4 is in the closed position. In the open position, a dispensing aperture 5 on the body is maintained visible and makes possible the dispensing of the product held in the container 2. In effect, the body 3 is mounted on the container 2 so that the dispensing aperture 5 is in fluid communication with the opening in the container 2, with the opening being concealed or covered by the body 3.

Preferably, this dispensing aperture 5 is defined at the level of a surface or seating 6 on the body 3, with the seating 6 defining a surface substantially orthogonal to the axis X.

The lid 4 is pivoted about a hinge 7 of axis 8, with the axis 8 of this hinge 7 being defined parallel to the surface of the seating 6, and orthogonally to the axis X. In the open position, the lid 4 defines an angle with the surface of the seating 6 preferably greater than 90°. More preferably, the opening angle is on the order of 130° or less. The seating 6 or body 3 incorporates a cavity 9, inside of which at least a portion of the lid 4 is disposed when it is in the open position.

With the axis 8 of the hinge 7 being defined at some distance from the edges or ends of the lid 4, the lid can therefore be defined by or to include two portions each disposed on either side of the axis 8. For example, a first portion 10 extends, in the closed position, above the dispensing aperture 5, while a second portion 11 serves as a tilt or bearing surface in order to move the first portion 10 from the closed position to the open position. The second portion 11 corresponds to the part of the lid 4 which tilts such that it is at least partially inside the cavity 9 in the open position.

Figure 2A:
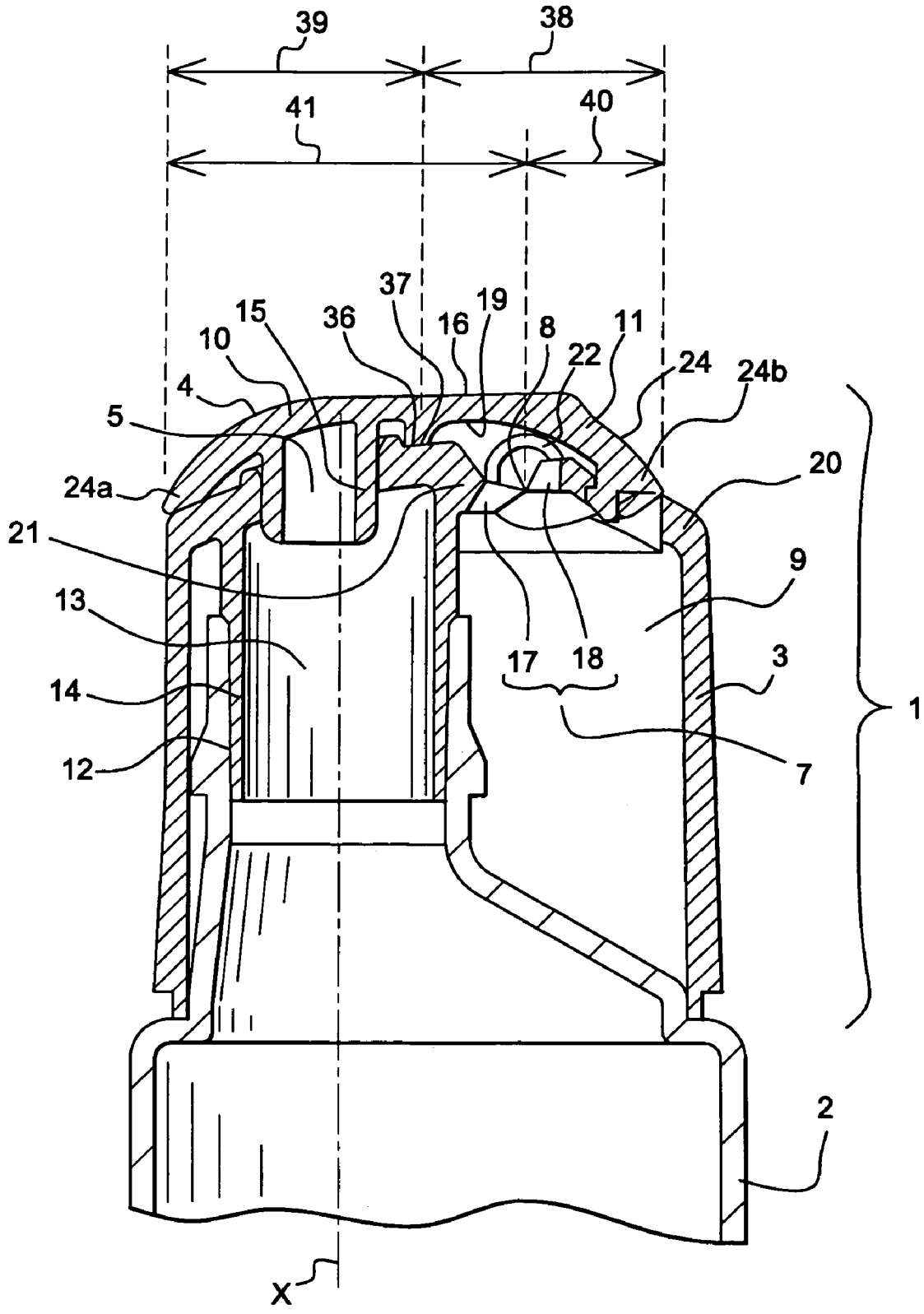
FIG. 2*a* is a lengthwise sectional view of a device according to the invention in the closed position.

As shown in FIG. 2*a* of the illustrated example, the container 2 preferably includes a neck 12 at which is defined the opening 13 in the container 2. The neck 12 forms a local restriction on the outside diameter of the container 2. The body 3 is preferably mounted, for example by force, on a part of the container 2 wider than the diameter of the neck 12. By way of example, in order to be held on the container 2, the body 3 incorporates a channel 14 in communication with the dispensing aperture 5, with this channel 14 being inserted inside the neck 12. Fluid communication is thus provided between the container 2 and the dispensing aperture 5. The channel 14 is mounted in a leaktight manner in the neck 12 to avoid leaks when the device is presented "upside down", i.e. with the dispensing aperture 5 oriented towards the ground.

In the embodiment shown in FIG. 2*a*, the lid 4 includes a stud 15 capable of engaging with the dispensing aperture 5 to thereby create a leaktight closure. Preferably, the aperture 5 has a circular cross-section and the stud has a counterpart cylindrical shape. The stud 15 moves inside the aperture 5 over a limited height. In effect, the lid is rotatable about the hinge 7 and in describing such a rotational movement, the stud 15 must be capable of emerging readily from this aperture 5 while at the same time ensuring effective leaktightness in the closed position.

The hinge 7 is preferably disposed at a lower surface 19 opposite the upper surface 16 of the lid 4. It is thus protected when the device is in the closed position. In this example, the hinge 7 is of the film-hinge type and includes a first part 17 integral with or coupled to the seating 6, and a second part 18 integral with or coupled to the lid 4. In the illustrated example, the axis 8 of the hinge 7 is formed by a plastic film between the first part 17 and the second part 18. The hinge 7 is preferably obtained, for example, by molding of plastic.

More particularly, the second part 18 is attached to the lower surface 19 of the lid 4. More particularly again, in the illustrated example, the second part 18 is attached to an area of this lower surface 19 disposed at the level of the second portion 11. Thus, when the lid 4 is moved to the open position, the second part 18 is caused to move in rotation relative to the first part 17.

In particular, the stud 15 is defined at the level of the lower surface 19, on a side of the lid 4 opposite the area to which the second part 18 is attached. The first part 17 is preferably attached to an area 21 of the seating 6 defined at the level of a rim 20 of the cavity 9, with the area 21 of this rim 20 being furthermore defined by an outer circumference of the channel 14 emerging from the neck 12.

Figure 2B:
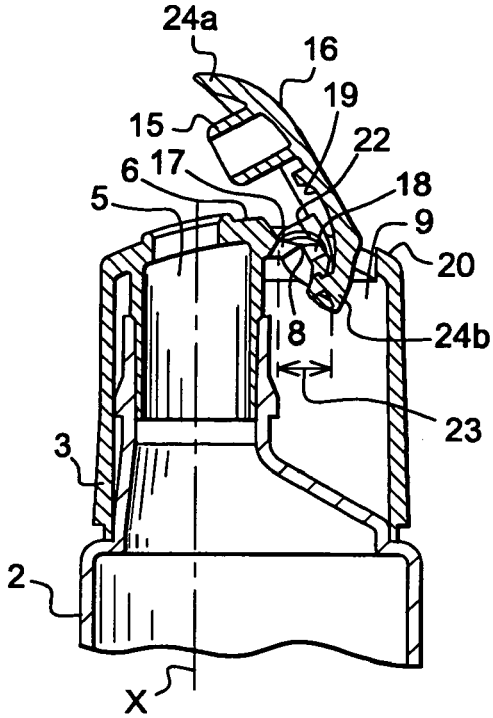
FIGS. 2*b* and 2*c* are two lengthwise sectional views of a device according to the invention in the opening position and in the open position.

In the example shown, the hinge 7 is of the spring effect type and to this end incorporates a resilient strip 22, connecting the first part 17 on one hand and the second part 18 on the other hand. In FIG. 2*b*, the resilient strip 22 is in a position of maximum extension corresponding to an unstable balance position. In effect, the distance 23 between the two points of attachment of the resilient strip 22 respectively to the two parts 17 and 18 is, in this position, slightly greater than the at-rest length of the resilient strip 22.

Figure 2C:
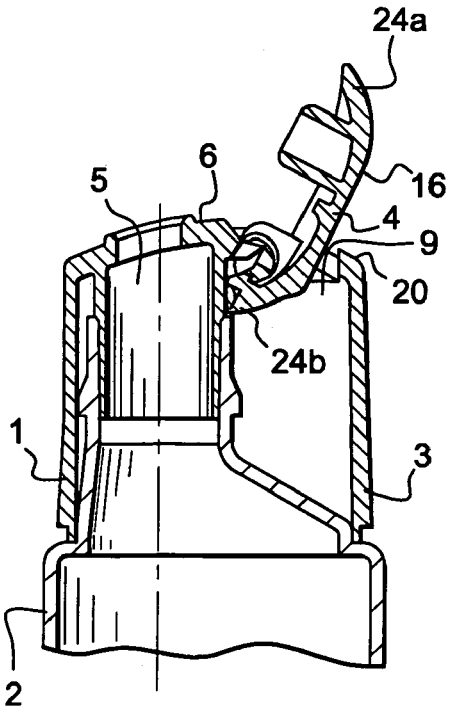

The strip 22 is attached to the two parts 17 and 18 such that the unstable position is obtained between the fully closed position as depicted in FIG. 2*a* and the fully open position as depicted in FIG. 2*c*. By way of example, this open position is in part defined by a stop formed by an edge 24 of the lid 4 against the outer circumference of the channel 14 emerging from the neck 12, or the outer circumference of the neck 12 itself. This outer circumference of the channel 14 or the outer circumference of the neck 12 can also participate in defining the inner circumference of the cavity 9 as shown.

In this open position, the resilient strip 22 is in a stable position and does not tend to return by itself to the unstable position shown in FIG. 2*b*. Thus when the container 2 on which the device 1 is mounted is moved, the lid 4 remains in the open position and does not impede the dispensing of product via the aperture 5. Furthermore, by the fact that the second portion 11, serving as a bearing surface to move the lid 4 into the open position is disposed inside the cavity 9, the user can grasp the container 2 over its full height, or at the level of the outer circumference of the body 3, without risk of applying pressure to the upper surface 16 and therefore of reclosing the lid 4.

The lid 4 includes, at the upper surface 16, two opposite ends 24*a* and 24*b* on an axis orthogonal to the axis 8, the first end 24*a* partly delineating the first portion 10 and the second end 24*b* partly delineating the second portion 11.

Figure 2D:
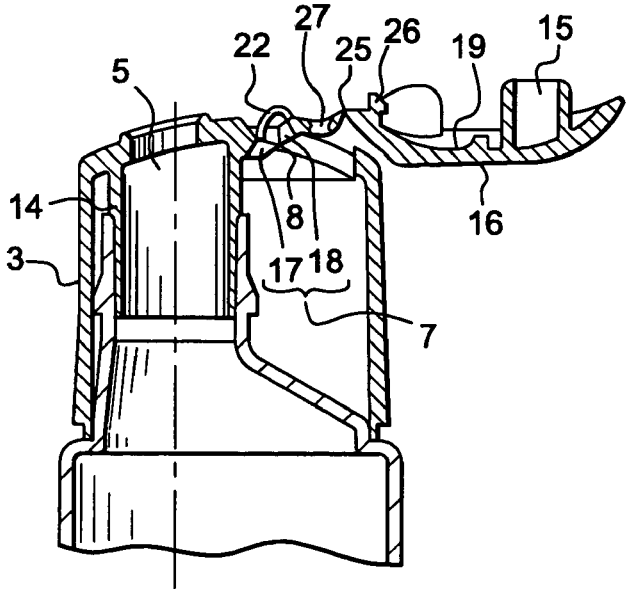
FIG. 2*d* is a lengthwise sectional view of a device according to the invention in the molding or molded position.

Preferably, the device 1 is molded in a single piece from a thermoplastic material. FIG. 2*d* shows the device 1 in the position in which it is molded. An additional feature of this mould in the illustrated example is that it has a second film-hinge 25 between the second part 18 and the lid 4, and this second film-hinge 25 allows a degree of movement of the lid 4 relative to the second part 18. This movement then facilitates assembly to the lid 4 relative to the second part 18 so as to make them integral. This arrangement can be advantageous in molding the device. The film-hinge 25 is, in this example, provided at the level of the second end 24*b*.

So that the movements applied to the lid 4 are transmitted to the second part 18, the lid 4 is fitted onto the second part 18, preferably in an irreversible manner, with a pinion or lug 26 engaging in a counterpart aperture 27. In the example, the pinion or lug 26 forms an emergent part of the lower surface 19 (here shown uppermost, before assembly) capable of being inserted into the counterpart aperture 27 provided in the second part 18. The assembly formed by the pinion 26 and counterpart aperture 27 provides an additional arrangement to secure the second part 18 to the lid 4.

Figure 3:
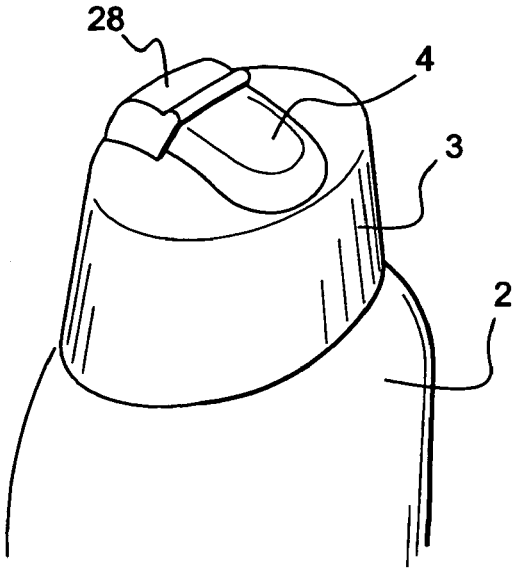
FIG. 3 is a profile or perspective view of an alternative embodiment of a device according to the invention in the closed position.
Figure 4:
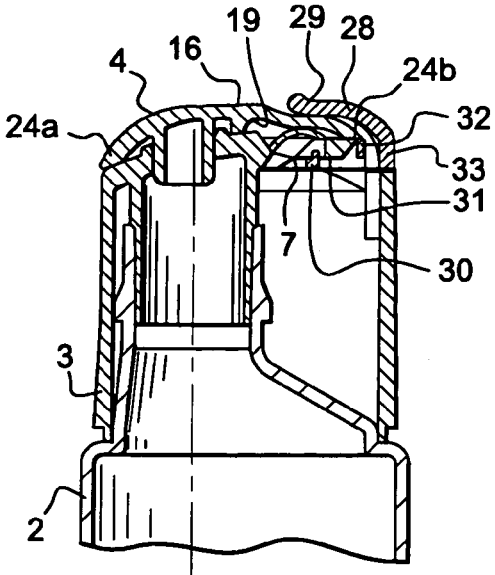
FIG. 4 is a lengthwise sectional view of a device according to FIG. 3.

As a variant, in the example shown in FIGS. 3 and 4, a device 1, e.g., such as previously described, does not necessarily include a pinion or lug such as 26 and a counterpart aperture such as 27. In this example, an external locking means or arrangement 28 can be mounted on the lid 4 so as to render its movement integral with the second part 18. This external locking arrangement 28 can secure the second part 18 to the lid 4.

This external locking arrangement 28 takes the form of a clamp. An upper part 29 of the clamp 28 comes into contact with the upper surface 16 of the lid 4, while a lower part 30 of the clamp 28 engages with a counterpart projection 31 presented by the second part 18 of the hinge 7 as shown in FIGS. 3 and 4.

In parallel, the device 1 according to the invention can also include an arrangement to lock the lid in the closed position. This locking arrangement can be provided on the lid 4 to be fully or partially integral with the movements of the second part 18. The locking arrangement can include at least one resilient tab which is preferably actuated by movements separate from those applied solely to tilt the lid 4 about the hinge 7. Generally, with the lid 4 in the closed position, in order to cause the lid 4 to tilt in the illustrated example, it is necessary to exert pressure in at least one direction (or with a component of the force extending) orthogonal to the upper surface 16 of the lid. For this reason, the configuration of the resilient tab is preferably chosen so that it is necessary to exert pressure thereon in at least one direction parallel to the upper surface 16 of the lid, with this pressure being preferably exerted from a different area of the bearing surface provided at the level of the second portion 11 of the lid 4.

According to a first embodiment, by way of example, the locking arrangement 28 can additionally perform this closed position locking function. In this case, the locking arrangement 28 includes at least one resilient tab 32 which bears against the second end 24*b* of the lid 4 so as to push back the locking arrangement 28 some distance from this second end 24*b*. The resilient tab 32 extends across the recess formed by the clamp, and notably the recess formed between the upper part 29 and the lower part 30.

Even though the resilient tab 32 repels the locking arrangement 28, the latter nonetheless remains integral with or coupled to the lid 4, and its travel in this direction is limited by the cooperation between the counterpart projection 31 and the lower part 30. Preferably, the tab 32 is arranged so that when the arrangement 28 mounted on the lid 4 forms an extension 33 of the second end 24*b* of the lid 4, this extension 33 is then opposite the rim 20 of the cavity 9. In this at-rest position, the arrangement 28 therefore prevents insertion of the lid 4 into the cavity 9. In the embodiments shown, the extension 33 corresponds to the junction point between the upper and lower parts 29 and 30 respectively.

In a second embodiment, illustrated in FIGS. 7*a* to 7*d*, the device 1 does not have a separate locking arrangement as 28. In particular, as shown in FIGS. 7*a* to 7*d*, the device 1 includes a resilient tab 50 connected to a cutout part or sloped portion 51 formed in the second portion 11 of the lid 4. Preferably, with this example, the lid 4 and the resilient tab 50 are made in one piece, in particular by molding.

Figure 7A:
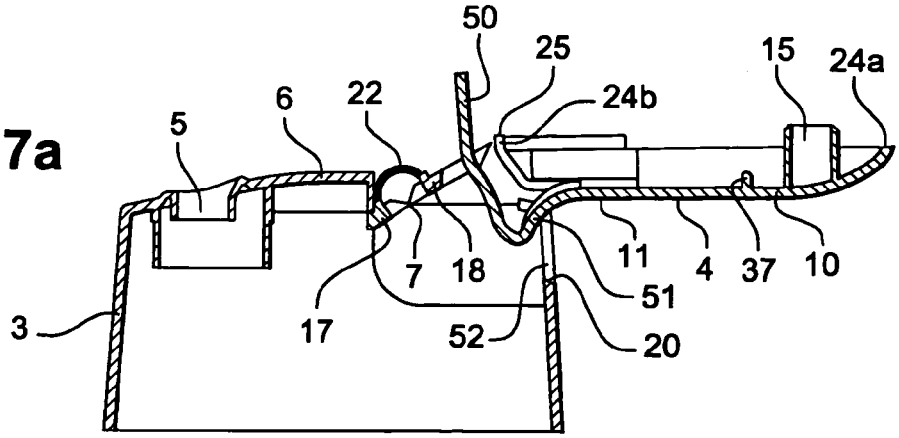
FIG. 7*a* is a lengthwise sectional view of a device according to a second embodiment of the invention in the molded or molding position.
Figure 7B:
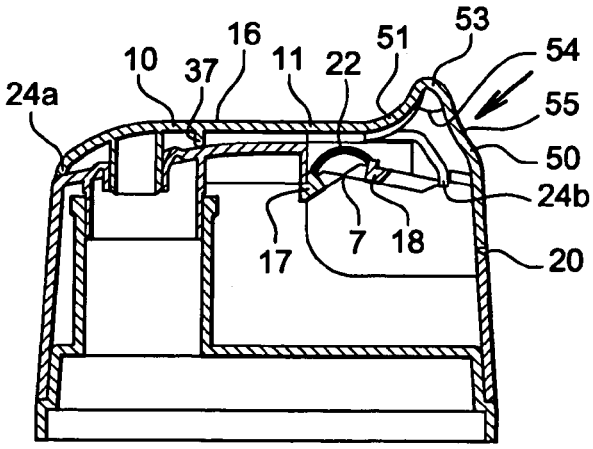
FIG. 7*b* is a lengthwise sectional view of a device according to a second embodiment of the invention in the closed position.

FIG. 7*a* shows the position in which the lid 4, the body 3 and the resilient tab 50 can be molded in a single pass. In this molding position, provision is also made to form the second film-hinge 25 between the second end 24*b* of the lid 4 and the second part 18. This film-hinge 25 extends over part of the circumference of the lid 4. Preferably the film hinge does not extend at the level of or in the portion of the circumference delineated by the cutout 51. The absence of the film-hinge 25 at the cutout 51 makes it easier to move the resilient tab 50 from its molding position (FIG. 7*a*) to an operational position (FIGS. 7*b* to 7*d*) in which the movements applied to the lid 4 are transmitted at least partially to the second part 18.

The movement from the molding position to the operational positions is obtained by elastic deformation of the resilient tab 50 in contact with the second part 18. In the molding position, the tab 50 is disposed substantially above the level of the first hinge 7, whereas in the operational positions, it is substantially disposed below the level of this hinge 7.

Furthermore, the structure of the resilient tab 50 is such that the return from the operational position to the molding position cannot be readily accomplished from the outer surface of the device 1 when it is mounted on a container 2. Even though, in the operational positions, and in particular as soon as the lid 4 has left the closed position, a degree of play is tolerated between the lid 4 and the second part 18, the resilient tab 50 preferably serves to ensure that the device 1 is maintained in operational configurations.

As a variant, provision may also be made in this second embodiment for cooperation of the type formed by the pinion or lug 26 and counterpart aperture 27 between the lid 4 and the second part 18 as discussed earlier.

To facilitate opening of the lid 4, it is first necessary to disengage the locking arrangement which locks the lid in the closed position. To do this, it is necessary to exert sufficient force to place the resilient tab 32 or 50 as appropriate under strain, until the locking arrangement 28 or 50 as appropriate does not remain against the rim 20, and therefore rotation of the lid 4 about the hinge 7, towards the inside of the cavity 9, is no longer prevented.

By way of example, the external surface of the upper part 29 can incorporate grooves to facilitate handling of the locking element 28 and to enable local pressure to be applied.

To impart a greater degree of flexibility to the resilient tab 50 in the second embodiment, it is preferable to provide this tab 50 with a sufficient length. Providing the tab with a sufficient length is particularly advantageous in providing sufficient play, with the arrangement formed as a one-piece molding of one material, for example, polypropylene. By way of example, a play in the order of several millimeters, i.e. the thickness of the edge of the rim 20 against which the tab 50 is presented, is obtained preferably without having to exert a force greater than 1.5 kg. For this reason, the rim 20 incorporates a notch 52 locally lowering the level of the rim 20 delineating the cavity 9 relative to the seating 6. Thus, the length of the tab 50 can be increased without modifying the overall vertical dimensions of the device 1.

By slightly increasing the vertical dimension of the device 1, as shown in FIGS. 7*a* to 7*d*, the cutout or upwardly sloping portion 51 in the lid 4 can be made so that it stands out relative to the level defined by the upper surface 16. Thus, the point of attachment 53 defined between the cutout 51 and the tab 50 can be slightly raised relative to the lid, which also makes it possible to increase the length of the tab 50 with a view to imparting greater flexibility thereto. For example, the point of attachment 53 contributes to the formation of a lug or protruding portion on the top of the lid 4. Preferably, an angle 54 defined between the outer circumference at the level of the cutout 51 and the tab 50 is less than 90°, and more preferably less than 70°.

Preferably, the tab 50 includes a concave portion 55, directly adjacent to the point of attachment 53, which is capable of accommodating at least one finger of a user.

Figure 7C:
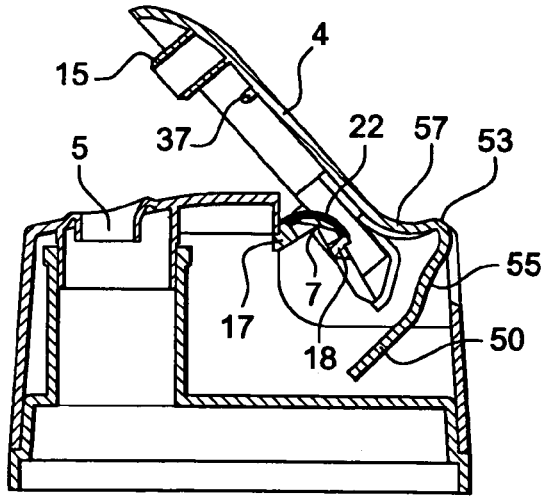
FIGS. 7*c* and 7*d* are two lengthwise sectional views of a device according to a second embodiment of the invention in the opening position and open position respectively.
Figure 7D:
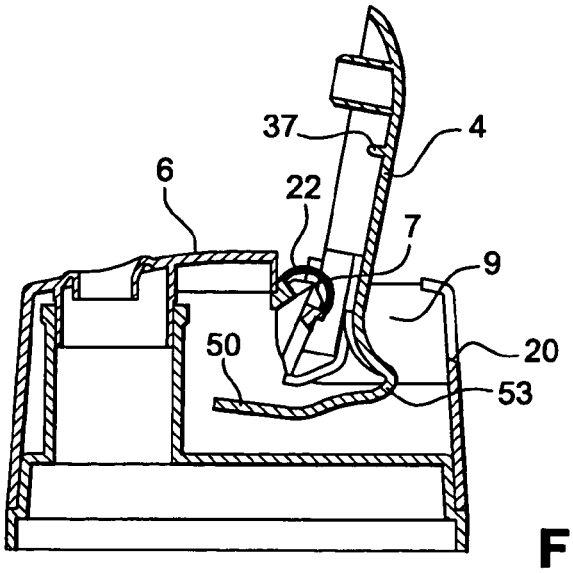

Thus, to facilitate opening of the lid according to the second embodiment, pressure is exerted in at least one direction parallel to a plane formed by the upper surface 16, i.e., in at least one direction orthogonal (or having a component orthogonal) or transverse to the outer surface of the resilient tab 50. The tab 50 is then deformed until its edge is no longer against the rim 20 of the cavity 9. Thereafter, or simultaneously, pressure can also be exerted in a direction orthogonal to the second portion 11 of the upper surface 16, as shown in FIG. 7*c*, and the lid 4 is then caused to move in rotation about the hinge 7.

A similar pressure exerted with the finger, for example on the concave portion 55, and oriented at 45° relative to the upper surface 16 and at 45° relative to the portion of the tab 50 adjacent to the rim 20, then includes components on the two axes identified above. Thus, with the same gesture, and using one hand, the user is able to unlock the closure means and cause the device to open by rotation of the lid. The lid 4 is then brought to the open position shown in FIG. 7*d*.

Figure 5A:
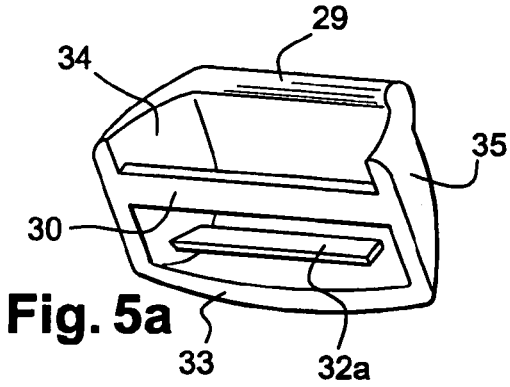
FIGS. 5*a*, 5*b* and 5*c* are profile or perspective views of different embodiments of a locking arrangement capable of being mounted on a device according to the invention.
Figure 5B:
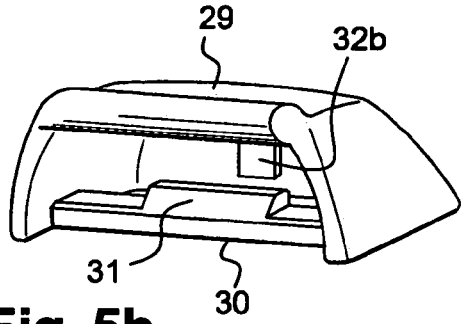
Figure 5C:
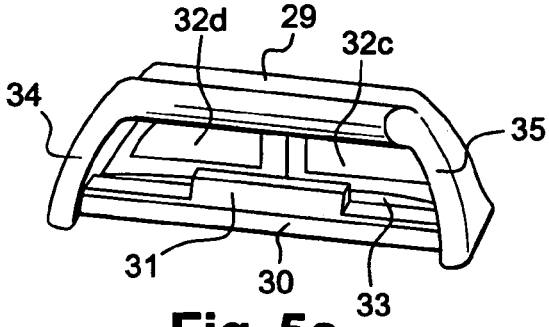

Various alternative embodiments of the locking arrangement 28 are depicted in FIGS. 5*a*, 5*b* and 5*c*. In each of these variants the upper part 29 forms a continuous surface up to the zone forming the extension 33. The lower part 30 is formed by a transverse beam connecting two lateral sides 34 and 35, with these two sides 34 and 35 connecting the upper part 29 to the lower part 30 on either side.

In a first variant, depicted in FIG. 5*a*, a tab 32*a* extends transversely between the upper part 29 and lower part 30, with the tab 32*a* in this case attached to one of the sides, in this instance at the inner surface of side 34.

In a second variant, depicted in FIG. 5*b*, the tab 32*b* extends transversely between the upper part 29 and lower part 30, with the tab 32*b* in this case attached at the level of the inner surface of the upper part 29 in the direction of the lower part 30.

In another variant, depicted in FIG. 5*c*, the device includes two tabs 32*c* and 32*d* each extending transversely between the upper part 29 and lower part 30, with each of the tabs in this case attached to one of the sides. In this instance, tab 32*c* is attached at the level of the inner surface of side 35, and tab 32*d* is attached at the level of the inner surface of side 34.

In the illustrated examples, the tabs 32 and 32*a* to 32*d* extend in a plane transverse, preferably orthogonal, to an axis on which the means 28 can be moved relative to the lid 4.

Figure 6A:
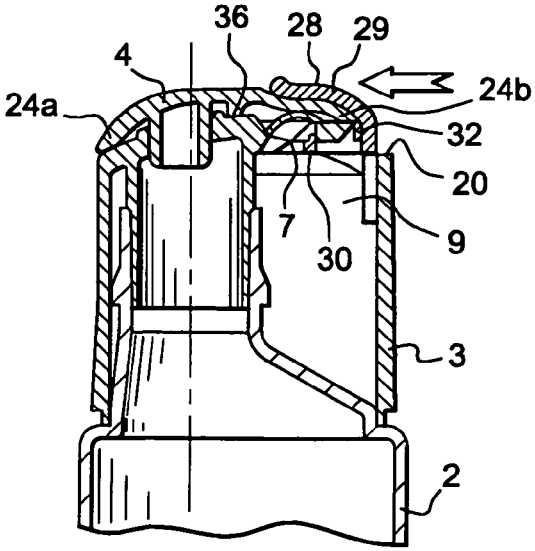
FIGS. 6*a* and 6*b* are lengthwise sectional view of a device according to the invention in the unlocking position and in the opening position.
Figure 6B:
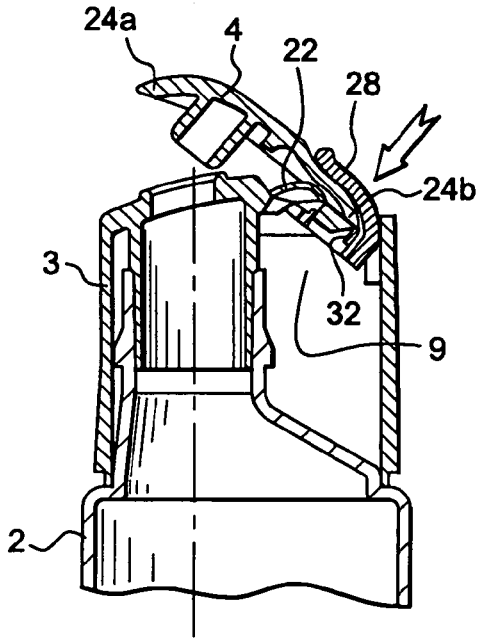

Thus, according to the first embodiment, in order to release the locking means 28, pressure is exerted on the locking arrangement 28 in at least one direction (or having a component) parallel to a plane formed by the upper surface 16. The tab such as 32 provided in the locking arrangement 28 is then compressed until it presses toward or against an inner surface of the means 28. In this position, illustrated in FIG. 6*a*, the means 28 is no longer against the rim 20 of the cavity 9. If a pressure is exerted in a direction at least orthogonal to the second portion 11 of the upper surface 16, as shown in FIG. 6*b*, the lid 4 is then caused to move in rotation about the hinge 7.

In the case where the lid 4 includes a stud 15, the balance of forces exerted at the level of the hinge 7 would mean, for a pressure exerted on the outer surface 16 of the second portion 11 to open the lid, a resistance opposes this force at the level of the inner surface of the first portion 10, by virtue of friction or resistance of the stud 15 mounted in a leaktight manner in its aperture 5.

Given that the pressure exerted by a user is generally on the order of 1.5 kg, if the resistance is higher than this value, in order to avoid the user having to use an undesirably excessive force to move the lid 4, the leverage values can be distributed in such a way that, by applying a force on the order of 1.5 kg or less, the stud 15 is still retracted from the aperture 5.

By way of example, the chosen length of the resistance leverage can be chosen such that it is shorter than the leverage length of the pressure force, with this length being determined relative to an axis orthogonal to the hinge axis 8. Generally, the chosen length of the first portion 10 can preferably be selected to be shorter than the length of the second portion 11 relative to this axis orthogonal to axis 8.

Alternatively, when such leverages cannot be applied by virtue of a chosen design, provision can be made to momentarily modify the various relative leverage lengths, for example at the onset of application of pressure on the second portion. This can be achieved by modifying the axis of the "effective hinge" at the start of opening of the lid 4. By modifying the resilience of the hinge 7 and/or the upper surface of the lid 4, which are both capable of deforming by absorbing part of the strain applied thereto, a temporary hinge axis 36 can be created momentarily; see notably FIGS. 2*a* and 6*a*.

This temporary hinge axis 36 can be formed by a brace 37 which bears on the seating 6, in this instance the brace 37 is disposed at the level of the lower surface 19 of the first part 10 of the lid 4, so that a leverage 38 associated with the pressure exerted on the second portion 11 is able to compensate or overcome the leverage 39 associated with the resistance caused by the stud 15 at the first portion 10. Rotation of the lid 4 is then partly obtained about the temporary hinge axis 36.

From the moment when both the hinge 7 and the lid 4 are no longer capable of absorbing the strain by elasticity, the axis of rotation then reverts to the axis 8 of the hinge 7, and the respective leverages 40 and 41 are more than sufficient to complete the opening action of the lid 4. At this stage, the stud is generally already retracted from the aperture 5, and there is no longer any force opposing the rotation imparted by the pressure on the second portion 11.

In an embodiment according to this alternative, the closure of the lid 4 is easy. The leverage 41 which can be obtained by pressure on the external surface 16 of the first part 10 is then greater than the leverage 40.

Throughout the description, including the claims, expressions such as including, comprising or having should be understood to be synonymous with "including at least", unless otherwise specified.

Of course, the invention is not limited to the examples described above, and the features of the different embodiments may be variously combined. Further, forms of the invention need not include each and every feature depicted in the illustrated embodiments.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A closure and dispensing device for a container, the device including:

(i) a body capable of being mounted on a container, the body including a dispensing aperture in communication with an opening of the container, and (ii) a lid capable of selectively closing off said dispensing aperture, wherein said lid is pivotable relative to the body about an axis of a hinge between an open position and a closed position, and wherein said lid is capable, in the absence of any external force, of remaining in the open position; and (iii) at least one resiliently deformable strip connecting the lid to the body, with a first terminal end part of said resiliently deformable strip fixed with respect to said body and a second terminal end part of said resiliently deformable strip fixed with respect to said lid;

wherein the lid includes first and second ends on an axis perpendicular to the hinge axis, wherein first and second portions of said lid are respectively associated with said first and second ends on opposite sides of the hinge axis, and wherein means to at least partially close the dispensing aperture are associated with said first portion, and wherein the hinge axis is located relative to said first and second ends so that opening of the lid occurs as a result of pressure exerted on the second portion of the lid situated between said hinge axis and the second end of the lid.

2. A device according to claim 1, further including a container upon which said closure and dispensing device is mounted.

3. A closure and dispensing device capable of being mounted at the level of an opening in a container, the device including:

(i) a body capable of being mounted around the opening of a container, the body including a dispensing aperture in fluid communication with the container, wherein the body further includes a cavity; and (ii) a lid which is pivotable relative to the body by means of a spring-effect hinge, wherein said spring effect hinge includes at least one resiliently deformable strip, and wherein said spring effect hinge includes a first part coupled to the body and a second part coupled to the lid, and further wherein said at least one resiliently deformable strip includes a first part connected to said first part of said hinge, and wherein said resiliently deformable strip further includes a second part connected to said second part of said hinge, wherein the lid includes first and second portions on each side of an axis of the hinge; and wherein the first portion of the lid includes means to close off the dispensing aperture in a closed position;

the second portion of the lid includes a bearing surface to enable the lid to be moved from the closed position to an open position; and wherein the second portion of the lid is at least partially accommodated in the cavity of the body when the lid is in the open position.

4. A device according to claim 3, wherein the lid forms a lever such that a force exerted on one of the first and second portions of the lid causes the first and second portions to pivot about the axis of the hinge.

5. A device according to claim 4, wherein in the closed position, the spring-effect hinge is concealed by the lid and the spring-effect hinge is positioned between the lid and the body.

6. A device according to claim 5, wherein the first part of the hinge is integral with the body and the second part of the hinge is integral with the lid, and wherein said resilient strip is fixed to the first and second parts of the hinge.

7. A device according to claim 6, wherein the first part of the hinge is attached to a rim extending around at least a portion of the cavity of the body, and wherein the second part of the hinge is attached to a lower surface of the second portion of the lid.

8. A device according to claim 7, wherein the second part of the hinge is connected at a location spaced from an end of the upper surface of the lid, and wherein the first part of the hinge is attached to an area of the rim which is as close as possible to the dispensing aperture.

9. A device according to claim 8, wherein under the effect of pressure exerted on the bearing surface, the axis of the hinge allows elastic deformation causing the second part to move relative to the first part.

10. A device according to claim 9, wherein under the effect of pressure exerted on the bearing surface, an upper surface of the lid is capable of compressing elastically towards a seating in the body.

11. A device according to claim 10, wherein a lower surface of the lid includes a brace which bears on the body so as to form a temporary local hinge axis during passage from the closed position to the open position.

12. A device according to claim 11, wherein the temporary local hinge axis is formed between the dispensing aperture and the axis of the hinge.

13. A device according to claim 12, wherein the hinge is in a stable position in the open and closed positions, and passes through an unstable balance position between the open and closed positions.

14. A device according to claim 13, wherein in the open position, an angle defined between the body and the lid is greater than 90°.

15. A device according to claim 14, wherein in the open position the angle between the body and the lid is not greater than 130°.

16. A device according to claim 14, wherein movement of the lid from the closed position to the open position is induced by pressure exerted in at least one direction orthogonal to the bearing surface.

17. A device according to claim 14, wherein the second portion has a length, in a direction orthogonal to the hinge axis, shorter than a length of the first portion in said direction.

18. A device according to claim 17, wherein a lower face of the first portion includes a stud which engages, in a leaktight manner, in the dispensing aperture in the closed position.

19. A device according to claim 18, further including means of locking the lid in the closed position to prevent movement of the lid from the closed position to the open position, and wherein the means of locking cooperates with a rim of the cavity.

20. A device according to claim 3, wherein in the closed position, the spring-effect hinge is concealed by the lid, and is positioned between the lid and the body.

21. A device according to claim 3, wherein the first part of the hinge is integral with the body and the second part of the hinge is integral with the lid, and wherein said resilient strip is fixed to the first and second parts of the hinge.

22. A device according to claim 21, wherein the first part of the hinge is attached to a rim extending around at least a portion of the cavity of the body, and wherein the second part of the hinge is attached to a lower surface of the second portion of the lid.

23. A device according to claim 22, wherein the second part of the hinge is connected at a location spaced from an end of the upper surface of the lid, and wherein the first part of the hinge is attached to an area of the rim which is as close as possible to the dispensing aperture.

24. A device according to claim 21, wherein under the effect of pressure exerted on the bearing surface, the axis of the hinge allows elastic deformation causing the second part of the hinge to move relative to the first part of the hinge.

25. A device according to claim 24, wherein a lower surface of the lid includes a brace which bears on the body so as to form a temporary local hinge axis during passage from the closed position to the open position.

26. A device according to claim 21, wherein under the effect of pressure exerted on the bearing surface, an upper surface of the lid is capable of compressing elastically towards a seating in the body.

27. A device according to claim 26, wherein a lower surface of the lid incorporates a brace which bears on the body so as to form a temporary local hinge axis during passage from the closed position to the open position.

28. A device according to claim 3, wherein under the effect of pressure exerted on the bearing surface, an upper surface of the lid is capable of compressing elastically towards a seating in the body.

29. A device according to claim 3, wherein the hinge is in a stable position in the open and closed positions, and passes through an unstable balance position between the open and closed positions.

30. A device according to claim 3, wherein in the open position, an angle defined between the body and the lid is greater than 90°.

31. A device according to claim 30, wherein in the open position the angle between the body and the lid is not greater than 130°.

32. A device according to claim 3, wherein movement of the lid from the closed position to the open position is induced by pressure exerted in at least one direction orthogonal to the bearing surface.

33. A device according to claim 3, wherein the second portion has a length, in a direction orthogonal to the hinge axis, shorter than a length of the first portion in said direction.

34. A device according to claim 3, wherein a lower face of the first portion includes a stud which engages, in a leaktight manner, in the dispensing aperture in the closed position.

35. A device according to claim 3, further including means of locking the lid in the closed position to prevent movement of the lid from the closed position to the open position, and wherein the means of locking cooperates with a rim of the cavity.

36. A device according to claim 35, wherein the means of locking includes at least one resilient tab.

37. A device according to claim 36, wherein pressure exerted on an outer surface of the means of locking, in at least one direction parallel to the bearing surface, facilitates compression of the resilient tab to enable the movement from the closed position to the open position.

38. A device according to claim 35, wherein the means of locking the lid in the closed position is formed as one piece with at least part of the lid.

39. A device according to claim 35, wherein the means of locking the lid in the closed position is at least partially fitted to the lid.

40. A device according to claim 3, wherein the device is made as a one piece molding of a thermoplastic material.

41. A device according to claim 40, wherein the thermoplastic material is polypropylene.

42. A device according to claim 40, wherein the thermoplastic material is a polyolefin.

43. A device according to claim 3, further including a container upon which said closure and dispensing device is mounted.

44. A device according to claim 3, further including a locking device which prevents movement of said lid from the closed position, and wherein unlocking of said locking device allows movement of said lid from the closed position to the open position, and further wherein during movement of said lid from the closed position to the open position said locking device moves with said lid.

45. A device according to claim 44, wherein a force having a component in a first direction against said locking devices unlocks said locking device, and wherein when said locking device is unlocked, a force having a component in a second direction against said bearing surface causes the lid to move from the closed position to the open position, and wherein the first direction is transverse to the second direction.

46. A closure and dispensing device comprising:

(i) a body which can be mounted to a container, said body including a dispensing aperture through which a product passes to dispense the product when the device is mounted on a container;

(ii) a lid which is pivotably connected to said body, wherein said lid is movable between an open position and a closed position, and wherein said lid includes a first portion which covers said dispensing aperture in said closed position, and further wherein said lid includes a second portion;

(iii) a locking device associated with said lid, said locking device preventing movement of said lid from said closed position, and wherein a force having a component in a first direction exerted against said locking device unlocks said locking device; and wherein when said locking device is unlocked, a force having a component in a second direction exerted on said second portion of said lid causes said first and second portions of said lid to pivot to move said lid from said closed position toward said open position, and wherein said locking device moves with and in a same direction as said second portion as said lid pivots from said closed position to said open position.

47. A closure device according to claim 46, wherein said locking device engages against a portion of a rim of said body in a locked position and movement of said locking device in said first direction moves said locking device away from said rim to unlock said locking device and allow movement of said lid from said closed position.

48. A closure device according to claim 47, wherein said locking device includes a resilient tab integrally formed as one piece with said lid.

49. A closure device according to claim 48, wherein said lid includes an upwardly projecting portion between said tab and said first portion of said lid.

50. A device according to claim 47, wherein said locking device includes a clamp device coupled to said second portion of said lid, and wherein said clamp device moves relative to said second portion in said first direction to move said locking device from the locked position to an unlocked position.

51. A device according to claim 47, wherein said body includes a cavity at least partially defined by said rim, and wherein said locking device enters said cavity when said lid is moved to said open position.

52. A device according to claim 51, wherein at least part of said second portion of said lid enters said cavity when said lid is moved to said open position.

53. A device according to claim 52, wherein a spring is coupled between said lid and said body, said lid having an unstable condition when said lid is at a position between said closed position and said open position, and wherein said lid is in a stable condition when said lid is in said open position and when said lid is in said closed position.

54. A device according to claim 51, wherein a hinge pivotably couples said lid to said body, said hinge having a first part coupled to said body and a second part coupled to said lid.

55. A device according to claim 54, wherein said hinge includes a thin film coupling said first part and said second part to define a hinge axis, and wherein said hinge axis is disposed between said first portion and said second portion of said lid.

56. A device according to claim 55, wherein said hinge is a spring hinge including a spring having an unstable condition when said lid is in a position between said open position and said closed position.

57. A device according to claim 46, wherein a hinge pivotably couples said lid to said body, said hinge having a first part coupled to said body and a second part coupled to said lid.

58. A device according to claim 57, wherein said hinge includes a thin film coupling said first part and said second part to define a hinge axis, and wherein said hinge axis is disposed between said first portion and said second portion of said lid.

59. A device according to claim 58, further including a temporary pivot axis formed at a location at which said lid and said body abut against each other, and wherein during at least a portion of initial movement of said lid from said closed position toward said open position said lid pivots about said temporary pivot axis and wherein further movement of said lid toward said open position moves said lid and said body out of abutment at said location.

60. A device according to claim 59, wherein said temporary pivot axis is disposed at a location between said hinge axis and said dispensing aperture when said lid is in said closed position.

61. A device according to claim 46, in combination with a container with which said device is associated.

62. A device and container according to claim 61, wherein said container includes a neck, and wherein a portion of said body is coupled to said neck.

63. A device and container according to claim 62, wherein said body defines a cavity in a region between said neck and a peripheral rim portion of said body, and wherein said second portion of said lid is at least partially disposed in said cavity when said lid is in said open position.

64. A device according to claim 63, wherein a portion of said body extends inside of said neck.

65. A device according to claim 46, wherein a spring hinge pivotably couples said lid to said body, and wherein when said lid is in said closed position said spring hinge is disposed between said lid and said body such that said spring hinge is concealed under said lid.

66. A closure and dispensing device comprising:

(i) a body which can be mounted to a container, said body including a dispensing aperture through which a product passes to dispense the product when the device is mounted on a container;

(ii) a lid which is pivotably connected to said body, wherein said lid is movable between an open position and a closed position, and wherein said lid includes a first portion which covers said dispensing aperture in said closed position, and further wherein said lid includes a second portion;

(iii) a hinge coupled between said lid and said body to pivotably connect said lid and said body, wherein a spring is associated with said hinge, wherein said spring is deformable by extension or compression to exert a spring force between said body and said lid, and wherein said spring has an unstable condition when said lid is at a location between said closed position and said open position, and wherein said spring has a stable condition when said lid is in said closed position and when said lid is in said open position;

wherein said hinge and said spring are disposed under said lid such that said hinge and said spring are concealed when said lid is in said closed position, and wherein the said hinge is positioned so that opening of said lid occurs as a result of pressure exerted on the second portion of the lid, which moves the first portion of the lid from the closed position.

67. A device according to claim 66, further including a locking device for locking said lid in said closed position.

68. A device according to claim 67, wherein when said locking device is unlocked, said lid is allowed to move from said closed position to said open position, and further wherein said locking device moves with said second portion during movement of said lid from said closed position to said open position.

69. A device according to claim 68, wherein said body includes a cavity, and wherein movement of said lid to said open position causes at least a portion of said locking device to move from a location outside of said cavity to a location inside of said cavity.

70. A device according to claim 66, wherein a cavity is disposed in said body, and wherein said second portion of said lid at least partially extends into said cavity when said lid is in said open position.

71. A device according to claim 66, wherein said hinge includes a hinge axis, and wherein a temporary hinge axis is disposed at a location between said hinge axis and said dispensing aperture, said temporary hinge axis providing a pivot location during at least a portion of initial movement of said lid from said closed position to said open position, and wherein after the initial movement said lid pivots about said hinge axis.

72. A closure and dispensing device capable of being mounted at the level of an opening in a container, the device including:

(i) a body capable of being mounted around the opening of a container, the body including a dispensing aperture in fluid communication with the container, wherein the body further includes a cavity; and (ii) a lid which is pivotable relative to the body by means of a spring-effect hinge, wherein the lid includes first and second portions on each side of an axis of the hinge; and wherein the first portion of the lid includes means to close off the dispensing aperture in a closed position;

the second portion of the lid includes a bearing surface to enable the lid to be moved from the closed position to an open position; and at least one resiliently deformable strip connects the lid to the body;

wherein the second portion of the lid is at least partially accommodated in the cavity of the body when the lid is in the open position; and wherein a lower surface of the lid includes a brace which bears on the body so as to form a temporary local hinge axis during passage from the closed position to the open position.

73. A closure and dispensing device capable of being mounted at the level of an opening in a container, the device including:

(i) a body capable of being mounted around the opening of a container, the body including a dispensing aperture in fluid communication with the container, wherein the body further includes a cavity; and (ii) a lid which is pivotable relative to the body by means of a spring-effect hinge, wherein the lid includes first and second portions on each side of an axis of the hinge; and wherein the first portion of the lid includes means to close off the dispensing aperture in a closed position;

the second portion of the lid includes a bearing surface to enable the lid to be moved from the closed position to an open position; and at least one resiliently deformable strip connects the lid to the body;

wherein the second portion of the lid is at least partially accommodated in the cavity of the body when the lid is in the open position; and wherein the device is made as a one piece molding of a thermoplastic material.

74. A closure and dispensing device comprising:

(i) a body which can be mounted to a container, said body including a dispensing aperture through which a product passes to dispense the product when the device is mounted on a container;

(ii) a lid which is pivotably connected to said body, wherein said lid is movable between an open position and a closed position, and wherein said lid includes a first portion which covers said dispensing aperture in said closed position, and further wherein said lid includes a second portion;

(iii) a hinge coupled between said lid and said body to pivotably connect said lid and said body, wherein a spring is associated with said hinge and has an unstable condition when said lid is at a location between said closed position and said open position, and wherein said spring has a stable condition when said lid is in said closed position and when said lid is in said open position;

wherein said hinge and said spring are disposed under said lid such that said hinge and said spring are concealed when said lid is in said closed position; and wherein said hinge includes a hinge axis, and wherein a temporary hinge axis is disposed at a location between said hinge axis and said dispensing aperture, said temporary hinge axis providing a pivot location during at least a portion of initial movement of said lid from said closed position to said open position, and wherein after the initial movement said lid pivots about said hinge axis.

75. A device according to claim 1, wherein said resiliently deformable strip is deformable by extension or compression to exert a spring force between said lid and said body.

76. A device according to claim 1, further including a locking device to lock the lid in the closed position and wherein a force required to unlock the locking device is in a direction transverse to a direction of pressure required on the second portion to move the lid from the closed position to the open position.

77. A device according to claim 3, wherein said resiliently deformable strip is deformable by extension or compression to exert a spring force between said lid and said body.

78. A device according to claim 3, wherein a film connects said first part of said hinge to said second part of said hinge, wherein said film is a separate part from said resiliently deformable strip.

79. A device according to claim 3, further including a film connecting said second part of the hinge to the lid.

80. A device according to claim 3, further including a locking device to lock the lid in the closed position and wherein a force required to unlock the locking device is in a direction transverse to a direction of pressure required on the second portion to move the lid from the closed position to the open position.

81. A device according to claim 80, wherein after unlocking of said locking device, the locking device moves with the second portion of the lid as the lid moves from the closed position to the open position.

82. A device according to claim 80, wherein the locking device is mounted on the second portion of the lid.

83. A device according to claim 3, wherein said lid pivots from said closed position to said open position, and wherein a locking device is at least partially mounted on said second portion of said lid such that when said lid is unlocked said locking device pivots with said second portion of said lid as said lid moves from the closed position to the open position.

84. A device according to claim 46, wherein said locking device is at least partially mounted on said second portion of said lid to move with said second portion as said lid moves from the closed position to the open position.

85. A device according to claim 46, wherein said locking device is integrally formed with said second portion and moves with said second portion as said lid moves from the closed position to the open position.

86. A device according to claim 46, further including a resiliently deformable strip which is deformable by compression or expansion to exert a spring force between said body and said lid.

87. A device according to claim 86, wherein said resiliently deformable strip forms at least part of a hinge connected between said lid and said body.

88. A device according to claim 87, wherein said hinge includes a first film part separate from said resiliently deformable strip.

89. A device according to claim 88, further including a second film part connecting said hinge to said lid.

90. A device according to claim 46, wherein said first direction is transverse to said second direction.

91. A device according claim 90, wherein said first direction is orthogonal to said second direction.

92. A device according to claim 46, wherein said locking device can be actuated independently of movement of said lid from said closed position to said open position such that said locking device can be unlocked while said lid is maintained in said closed position, and thereafter said lid can be moved from said closed position to said open position.

93. A device according to claim 66, wherein said hinge includes first and second parts, and wherein first and second parts of said spring are respectively fixed to said first and second parts of said hinge.

94. A device according to claim 66, wherein said hinge includes a first part fixed to said body and a second part fixed to said lid.

95. A device according to claim 66, wherein said hinge includes first and second parts connected by a film, and wherein said thin film is a separate part from said spring.

* * * * *